US007938571B1

(12) United States Patent
Irvine

(10) Patent No.: US 7,938,571 B1
(45) Date of Patent: May 10, 2011

(54) FLY ASH TREATMENT SYSTEM AND METHOD OF USE THEREOF

(75) Inventor: James H. Irvine, Cincinnati, OH (US)

(73) Assignee: Flyashdirect, Ltd., Cincinnati, OH (US)

( * ) Notice: Subject to any disclaimer, the term of this patent is extended or adjusted under 35 U.S.C. 154(b) by 970 days.

(21) Appl. No.: 11/827,512

(22) Filed: Jul. 12, 2007

Related U.S. Application Data

(63) Continuation-in-part of application No. 11/504,267, filed on Aug. 15, 2006, which is a continuation-in-part of application No. 11/247,489, filed on Oct. 11, 2005, now abandoned.

(51) Int. Cl.
*B01F 5/24* (2006.01)

(52) U.S. Cl. ..... 366/107; 366/137.1; 366/173.2; 366/181.3; 366/183.2

(58) Field of Classification Search ..... 366/76.3, 366/76.4, 76.6, 76.9–76.93, 137.1, 178.1–178.3, 366/181.1, 183.1, 167.1, 173.1–173.2, 101, 366/106, 107, 181.3, 183.2
See application file for complete search history.

(56) References Cited

U.S. PATENT DOCUMENTS

| | | | | |
|---|---|---|---|---|
| 2,900,176 | A | 8/1959 | Krogel | |
| 3,164,374 | A | 1/1965 | Ralph | |
| 3,784,169 | A | 1/1974 | Bockmann et al. | |
| 3,879,021 | A * | 4/1975 | Riley | 366/137.1 |
| 3,976,030 | A * | 8/1976 | Ragsdale et al. | 118/303 |
| 4,298,288 | A | 11/1981 | Weisbrod | |
| 4,419,135 | A | 12/1983 | Hoge | |
| 4,585,353 | A | 4/1986 | Schonhausen | |
| 4,801,210 | A | 1/1989 | Gian | |
| 4,815,860 | A | 3/1989 | Deuse | |
| 4,832,497 | A * | 5/1989 | Wentzel | 366/9 |
| 4,948,429 | A | 8/1990 | Arfaei | |
| 5,080,022 | A | 1/1992 | Carlson | |
| 5,252,636 | A | 10/1993 | Ellenberger et al. | |
| 5,286,292 | A | 2/1994 | Tsukada et al. | |
| 5,308,159 | A | 5/1994 | Misuraca | |
| 5,456,751 | A | 10/1995 | Zandi et al. | |
| 5,536,310 | A | 7/1996 | Brook et al. | |

(Continued)

FOREIGN PATENT DOCUMENTS

EP 0707030 A1 * 4/1996

(Continued)

OTHER PUBLICATIONS

D. Gene Daniel and Colin L. Lobo, "User's Guide to ASTM Specification C94 on Ready-Mixed", ASTM International Standards Worldwide, pp. 37-40.

ASTM Designation: C 618, Standard Specification for Coal Fly Ash and Raw or Calcined Natural Pozzolan for Use in Concrete, pp. 1-3, ASTM International, 100 Barr Harbor Drive, P.O. Box C700, West Conshohocken, PA 19428-2959, Feb. 2003.

(Continued)

*Primary Examiner* — Charles E Cooley
(74) *Attorney, Agent, or Firm* — Wyatt, Tarrant & Combs, LLP

(57) ABSTRACT

The present invention provides a system for treating powder materials, such as fly ash, cement, slag, or the like, and a method of use thereof. The material treatment system facilitates the application of a desired chemical entity to the material passing through the system. The material treatment system disclosed herein is capable of performing this task while the material is moved at a high velocity. The system includes a fluidized bed chamber, discharge chamber, application chamber, and concentration chute. The result is the quick and consistent application of a chemical entity to the material so that the treated material has the desired characteristics.

13 Claims, 13 Drawing Sheets

U.S. PATENT DOCUMENTS

| | | | | |
|---|---|---|---|---|
| 5,556,458 | A | | 9/1996 | Brook et al. |
| 5,660,466 | A | * | 8/1997 | Hopson et al. ..... 366/137.1 |
| 5,685,640 | A | * | 11/1997 | Goedicke et al. ..... 366/107 |
| 5,803,596 | A | | 9/1998 | Stephens |
| 5,887,724 | A | | 3/1999 | Weyand et al. |
| 6,136,089 | A | | 10/2000 | Hurt et al. |
| 6,599,358 | B1 | | 7/2003 | Boggs |
| 6,638,355 | B2 | | 10/2003 | Shulman |
| 6,706,111 | B1 | | 3/2004 | Young |
| 6,773,500 | B1 | | 8/2004 | Creamer et al. |
| 6,890,507 | B2 | | 5/2005 | Chen et al. |
| 6,945,179 | B2 | | 9/2005 | Ramme et al. |
| 7,144,204 | B2 | | 12/2006 | Hilgraf |
| 2004/0129180 | A1 | | 7/2004 | Boggs |
| 2004/0144287 | A1 | | 7/2004 | Tardif et al. |
| 2004/0206276 | A1 | | 10/2004 | Hill et al. |
| 2006/0140832 | A1 | | 6/2006 | Luomaharju et al. |
| 2007/0045299 | A1 | | 3/2007 | Tranquilla |
| 2007/0051277 | A1 | | 3/2007 | Hill et al. |
| 2007/0094930 | A1 | | 5/2007 | Bailey, Sr. |

FOREIGN PATENT DOCUMENTS

| | | | | |
|---|---|---|---|---|
| JP | 52044451 | A | | 4/1977 |
| SU | 982769 | | * | 12/1982 |
| WO | WO 03024579 | A1 | * | 3/2003 |
| WO | WO 2004/067198 | | | 8/2004 |

OTHER PUBLICATIONS

ASTM Designation: C-114, Standard Test Methods for Chemical Analysis of Hydraulic Cement, pp. 1-31, ASTM International, 100 Barr Harbor Drive, P.O. Box C700, West Conshohocken, PA 19428-2959, Sep. 2000.

ASTM Designation: C-311, Standard Test Methods for Sampling and Testing Fly Ash or natural Pozzolans for use as a Mineral Admixture in Portland Cement Concrete, pp. 1-9, ASTM International, 100 Barr Harbor Drive, P.O. C700 West Conshohocken, PA 19428-2959, Sep. 2000.

ASTM Designation: C-430, Standard Test Method for Fineness of Hydraulic Cement, pp. 1-3, ASTM International, 100 Barr Harbor Drive, P.O. Box C700, West Conshohocken, PA 19428-2959, Aug. 2003.

ASTM Designation: C-231, Standard Test Method for Air Content of Freshly Mixed Concrete by the Pressure Method, pp. 146-154, ASTM International, 100 Barr Harbor Drive, P.O. Box C700, West Conshohocken, PA 19428-2959, Sep. 2003.

ASTM Designation: C-188, Standard Test Method for Density of Hydraulic Cement, pp. 1-2, ASTM International, 100 Barr Harbor Drive, P.O. Box C700, West Conshohocken, PA 19428-2959, Nov. 1995.

ASTM Designation: C-94, Standard Specification for Ready-Mixed Concrete, pp. 47-56, ASTM International, 100 Barr Harbor Drive, P.O. Box C700, West Conshohocken, PA 19428-2959, Jun. 2003.

* cited by examiner

FLY ASH TREATMENT SYSTEM AND METHOD OF USE THEREOF

This application is a continuation-in-part application of co-pending U.S. patent application Ser. No. 11/504,267, filed Aug. 15, 2006, entitled "Fly Ash Treatment System and Method of Use Thereof," which is hereby incorporated by reference in its entirety, which is a continuation-in-part application of U.S. patent application Ser. No. 11/247,489, filed Oct. 11, 2005, now abandoned, entitled "Fly Ash Treatment System and Method of Use Thereof," which is hereby incorporated by reference in its entirety.

STATEMENT REGARDING FEDERALLY SPONSORED RESEARCH OR DEVELOPMENT

Not applicable

REFERENCE TO A "MICROFICHE APPENDIX"

Not applicable

FIELD OF THE INVENTION

The present invention relates to the treatment of byproducts produced by coal-burning power plants. More particularly, fly ash, so that an alternate use is available.

BACKGROUND OF THE INVENTION

Coal Burning power plants in the United States and around the world produce tens of millions of tons of fly ash annually. The single largest beneficial application for fly ash is as a mineral admixture in concrete product markets. However, only a small percentage of annual fly ash production is utilized in concrete markets.

Emission Control technologies, implemented to reduce toxic air pollutants from coal burning power plants have had the negative consequence of producing fly ash with elevated levels of carbon or carbon that is highly absorptive/reactive. The resulting fly ash is unusable in the concrete industry and therefore must be land filled which increases costs to the electric power industry.

Fly ash utilization in concrete markets solves massive disposal problems and results in significantly improved concrete quality. During the concrete production process, air entraining agents (AEA's) are added to create a microscopic matrix of air bubbles. This air void matrix in concrete provides escape chambers for water that freezes/thaws due to changes in temperature. The freezing and thawing activity of water in concrete is a primary contributor to pre-mature cracking and long term durability issues.

AEA's have a high affinity for carbon which effectively de-activates the AEA's leaving concrete with reduced levels of air voids necessary for long term durability. Accordingly, in order to make use of the large abundance of fly ash produced annually, it is necessary to neutralize the reactive carbon existing in the fly ash.

The currently existing treatment systems and methods do not solve this problem. Fly ash is an extremely fine material that tends to absorb moisture in air resulting in a packing effect when stored or transported at a power plant. Proactive steps must be taken to prevent clumping and bridging as fly ash treatment is administered. Failure to do so results in treatment which is inconsistent and unpredictable. Also, fly ash is produced in massive quantities daily and must be rapidly treated to keep pace with production levels. Due to the extreme material handling aspects and production levels of fly ash, existing methods of chemical treatment merely dose fly ash as it free falls via gravity out of the silos in clumps, resulting in incomplete contact with the chemical agent. Further, inconsistent fly ash loading time makes it impossible to accurately dose chemical agents required for consistent homogeneous contact with carbon. Agents currently used in the treatment of fly ash may not be specific for carbon, may have activity similar to air-entrainment agents (thereby causing AEA dosing problems), have biological activity, may be leached from concrete by water, or may chemically degrade. Further, the carbon particles have a minimal opportunity to interact with the treatment compound. For these reasons—existing methods of treatment simply utilize AEA's to pre-dose the fly ash.

The invention solves the root problem of neutralizing the reactive carbon particles residing within the fly ash allowing the fly ash to be utilized in concrete production. The invention also reduces truck loading times by effectively treating the carbon as it exits the boiler en-route to the fly ash silo. Since trucking, or transportation, of the fly ash is a significant aspect of the cost, there is a need for a system and method of fly ash treatment such as the one described herein. The invention is designed to provide homogeneous application of a sacrificial agent to fly ash in order to provide fly ash having reduced carbon levels which are adequate for use in the concrete industry.

SUMMARY OF THE INVENTION

Disclosed herein is a material treatment system, and a method of use thereof. Specifically, powder-like materials such as fly ash, cement, slag, or the like, may be treated by an embodiment of the invention disclosed herein. Specifically, for fly ash, the material may be treated as it is produced at a coal-burning facility. A microscopic matrix of air called "air entrainment" is necessary in concrete to provide increased durability in freeze/thaw conditions. Water present in concrete expands as it freezes. Suitable air entrainment is required to accommodate the water as it expands due to temperature changes. Air may be provided in concrete by the addition of air entraining agents (AEA). AEA's have a strong affinity for carbon which effectively deactivates the agents. Accordingly, fly ash with a reactive carbon content deactivates the AEA, reduces the percentage of air in the concrete and results in premature cracking concrete and reduced durability characteristics. Accordingly, it is important to have the proper equipment for fly ash treatment which consistently results in a homogenous application of a chemical entity to the fly ash. Many other powder-like materials, such as cement, slag, or the like, require the application of a chemical entity in a consistent and even manner so that each of the individual parts, or molecules, of the material receives the chemical entity in order to have the desired effect. Accordingly, presentation of such materials in a truly dilute phase optimizes the process of applying chemical entities thereto. The present invention is a treatment system which transitions materials from a dense phase into a truly dilute phase for the application of a chemical entity. After application is complete, the treatment system disclosed herein then transitions the materials back into the dense phase.

Disclosed herein is a material treatment system, including, a conduit for receiving material; a fluidized bed chamber defining a first opening and a second opening, the first opening being in fluid communication with the conduit, the cross sectional area of the first opening being at least five times greater than the cross sectional area of the second opening; a discharge chamber attached to the fluidized bed chamber in order to receive the fluidized material; an application chamber attached to the discharge chamber, the application chamber having adjustable baffles so that the thickness of the flow path of the material is adjustable, the application chamber having a plurality of nozzles for applying the chemical entity to the material; a concentration chute having a first opening and a second opening, the first opening being attached to the application chamber, the first opening having a cross sectional area that is at least five times greater than the cross sectional area of the second opening, so that the material is concentrated for passage through the second opening of the concentration chute; a chemical conduit attached to the application chamber; and a chemical pump attached to the chemical conduit. In certain embodiments, the material treatment may further include a master flow controlling device communicationally attached to the chemical pump so that the chemical pump decreases or increases a rate of chemical flow in response to a signal from the master flow controlling device. In still other embodiments, the system may further include a fluidized bed chamber having a deflection gate, wherein the deflection gate is the width of the fluidized bed chamber in order to spread the material evenly so that it falls into the discharge chamber in an even manner. In certain embodiments this deflection gate may be adjustable. In still other embodiments, the nozzles are positioned directly beneath the adjustable baffles. In still other embodiments, the plurality of nozzles are on either side of the flow path of the material, and have from about ten nozzles to about fourteen nozzles. In still other embodiments, there may be one nozzle on each side of the flow path of the material for each one foot of width of the application chamber. In still other embodiments, the first opening of the conduit has a cross sectional area of from about 28 inches squared to about 114 inches squared. In other embodiments, the second opening of the fluidized bed chamber has a cross sectional of from about 600 inches squared to about 840 inches squared. In other embodiments, the adjustable baffles extend the width of the application chamber so that the thickness of the flow path is consistent along the width of the application chamber and so that the material received by the concentration chute is free falling. In still other embodiments the fluidized bed chamber and the concentration chute have sample ports.

Disclosed herein, also, is a fly ash treatment system, including, an air chute defining a first opening; a fluidized bed chamber attached to the air chute, the fluidized bed chamber having an adjustable deflection gate in order to control the rate of transportation of fly ash, the fluidized bed chamber having a first opening and a second opening, the first opening being attached to the air chute, the first opening having a width of at least five times the width of the air chute; a discharge chamber attached to the fluidized bed chamber, defining a plurality of openings so that dust is vented out; an application chamber attached to the discharge chamber, the application chamber being positioned lower than the discharge chamber, the application chamber having a pair of adjustable baffles so that the flow path of the fly ash may have a predetermined thickness along the width of the application chamber, the application chamber having a plurality of nozzles for the delivery of a chemical entity to the fly ash; a concentration chute attached to the application chamber, the concentration chute being positioned beneath the application chamber, the concentration chute defining a first opening and a second opening, the first opening having a width that is at least five times that of the width of the second opening.

Also disclosed herein is a method of treating fly ash, including receiving fly ash in a first conduit having a predetermined cross sectional area; transporting the fly ash to a second conduit having a predetermined cross sectional area that is at least five times greater than the cross sectional area of the first conduit; fluidizing the fly ash; free falling the fly ash; applying a chemical to the fly ash; and condensing the fly ash into a third conduit having a cross sectional area that is at least five times less than the cross sectional area of the second conduit. In certain embodiments, the method may also include transporting the fly ash at a rate of from about 1,000 pounds per minute to about 15,000 pound per minute. In certain embodiments, the method may be practiced by receiving fly ash from an ash silo. In still other embodiments when fluidizing the fly ash, there is movement of the fly ash at a rate that is not less than the movement rate of fly ash when it is being transported from a silo to a pneumatic truck. In still other embodiments of the method, the movement rate of the fly ash from the silo to the pneumatic truck is from about 1,000 pounds per minute to about 15,000 pounds per minute.

DETAILED DESCRIPTION OF THE INVENTION

Figure 1:
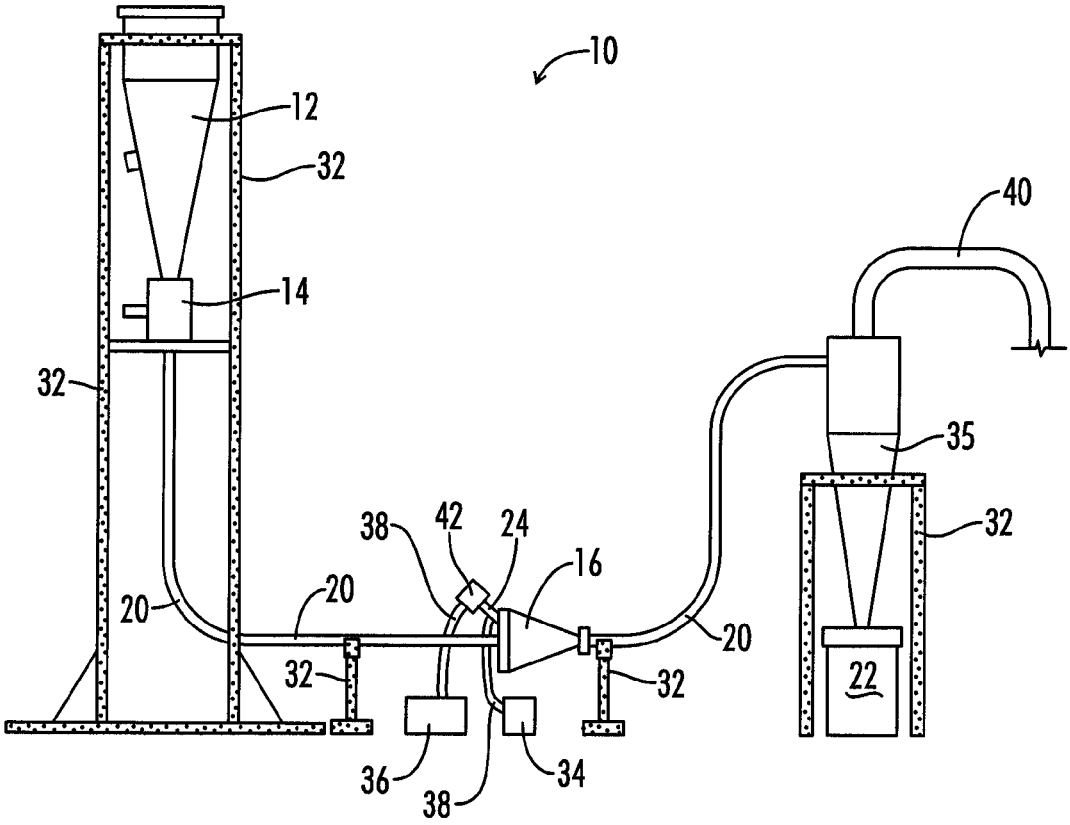
FIG. 1 is a schematic drawing of an embodiment of the fly ash treatment system for treatment at a coal-burning power plant. Shown there is a first storage chamber for collecting the fly ash to be treated, a rotary feeder for transferring the fly ash to the treatment chamber, and the treatment chamber including a chemical nozzle. A chemical pump supplies the sacrificial agent which is atomized into a mist by the compressed air source and nozzle. The transportation pipe allows the fly ash and sacrificial agent to undergo chemical reactions as they mate, or assimilate as they are transported to the second storage chamber.

The invention disclosed herein is a material treatment system 210. The material treatment system 210 may be used to treat fly ash, cement, or the like, by creating optimal positioning of the material 260 for the application of a chemical entity 262. The present invention describes the material treatment system 210, or device which facilitates the application of a desired chemical entity 262. The material treatment system 210 is used to expand highly concentrated material 260 for the application of the chemical entity 262 and then reconcentrate those materials 260 into a dense form. The embodiments of the invention disclosed herein are capable of performing this task while maintaining the high velocity movement of material 260, such as fly ash, such that proper chemical application occurs without decreasing the flow rates of the material 260, which may be at a coal burning facility, or the like. In certain embodiments, the material treatment system 210 includes a conduit 212, a fluidized bed chamber 214, a discharge chamber 220, an application chamber 222, a concentration chute 226, a chemical conduit 254, and a chemical pump 230. An embodiment of this invention is disclosed in FIGS. 9-22.

Also disclosed herein is a method of treating material 260. In certain embodiments, the method includes receiving material 260 in a first conduit having a predetermined cross sectional area, transporting the material 260 to a second conduit having a predetermined cross sectional area that is at least five times greater than the cross sectional area of the first conduit, fluidizing the material 260, free falling the material 260, applying a chemical to the material 260, and condensing the material 260 into a third conduit having a cross sectional area that is at least five times less than the cross sectional area of the second conduit. Such a method results in the treatment of material 260, such as fly ash while maintaining the velocity of movement which is ordinarily encountered at a coal burning facility. An embodiment of this invention is disclosed in FIGS. 9-22.

Figure 6:
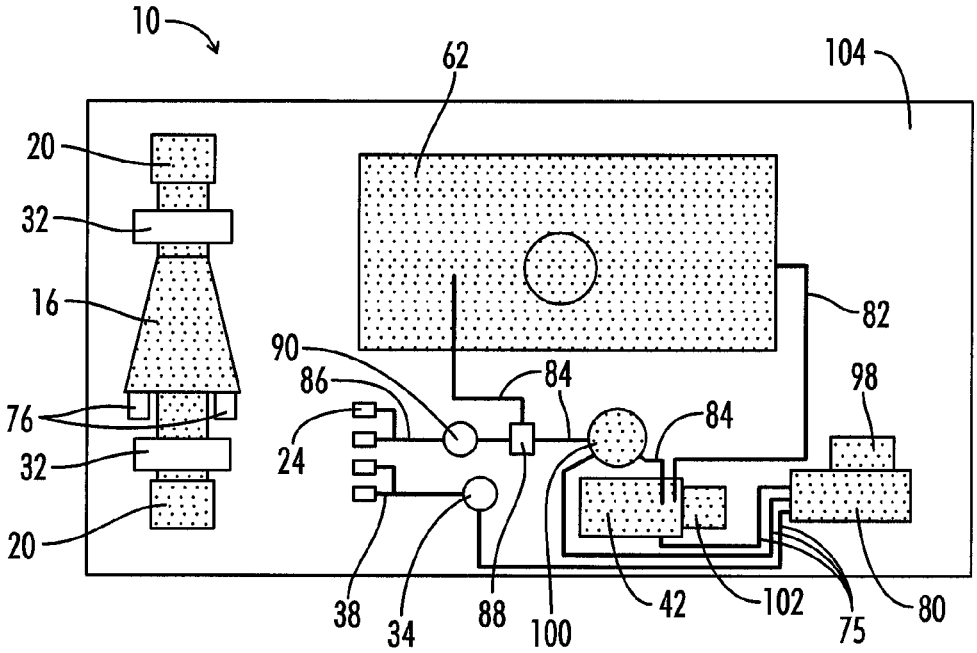
FIG. 6 is a top view of an embodiment of the present invention. Shown in that embodiment is the positioning of the tank relative to the fly ash transportation pipe and treatment chamber.
Figure 7:
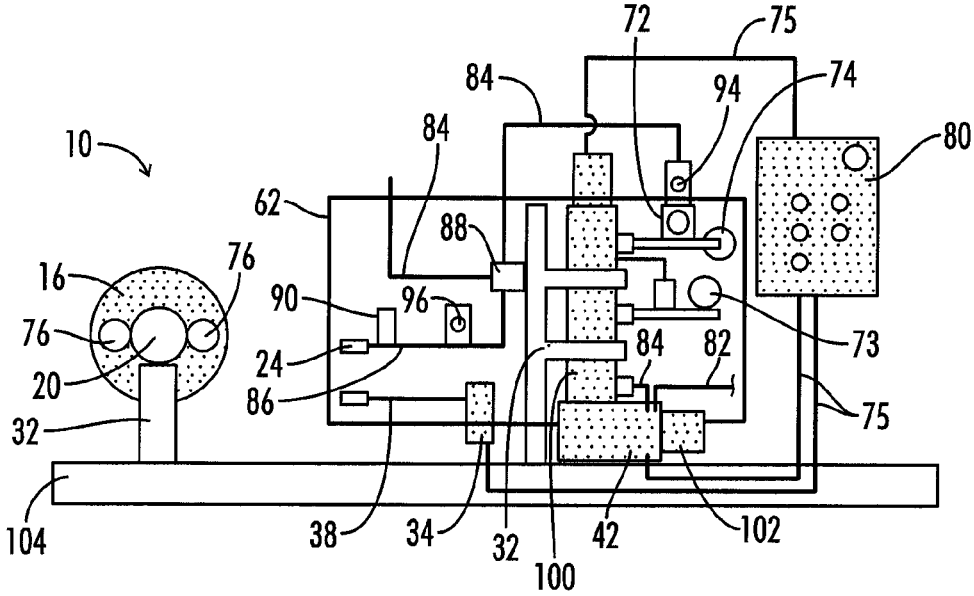
FIG. 7 is a side view of an embodiment of the present invention. Shown in that embodiment is the positioning of the modules of the present invention.
Figure 8:
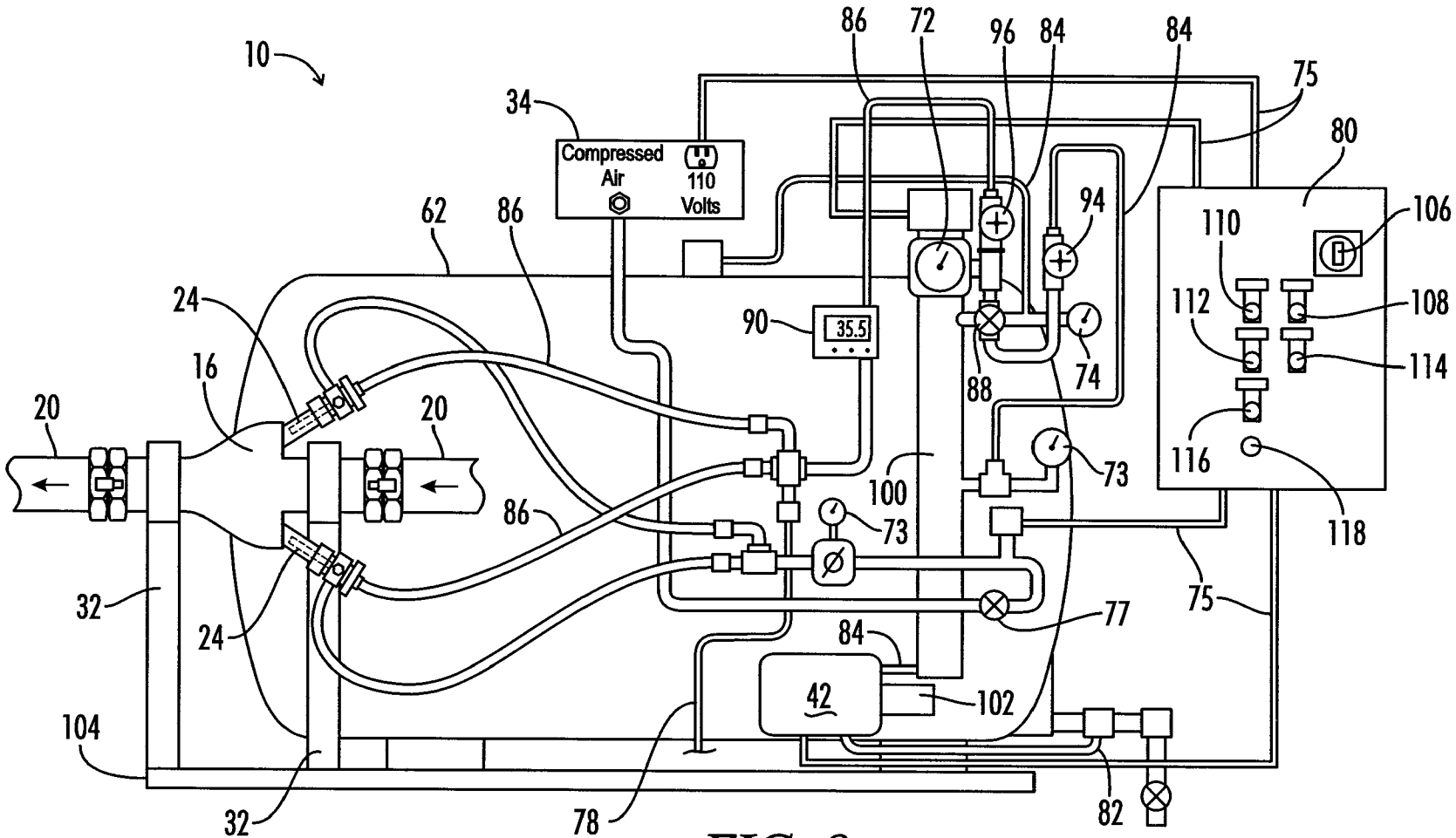
FIG. 8 is a side view of another embodiment of the present invention. Shown there is the entire pathway of the chemical entity from the storage tank to the treatment chamber.

As described generally in FIGS. 6-8, this patent application discloses fly ash treatment system 10 and method thereof for treating fly ash as it is unloaded from a pneumatic truck. Also disclosed is another embodiment of the system 10 for treating fly ash at a power plant. The present methods of treating fly ash result in fly ash which is treated with consistent results and resolves the problems of the currently available treatment methods, including fly ash clumping, bridging and non-homogenous chemical application. The resolution of these problems is due to the system 10 disclosed herein. The method of treating fly ash as it is unloaded from a pneumatic truck relieves a concrete manufacturer from the burden of storing untreated fly ash.

The first description herein is the disclosure of an embodiment of the system 10 which is used to treat fly ash at a power plant. The following description is that of an embodiment of the system 10 which is used to treat fly ash as it is unloaded from a pneumatic truck.

Figure 2:
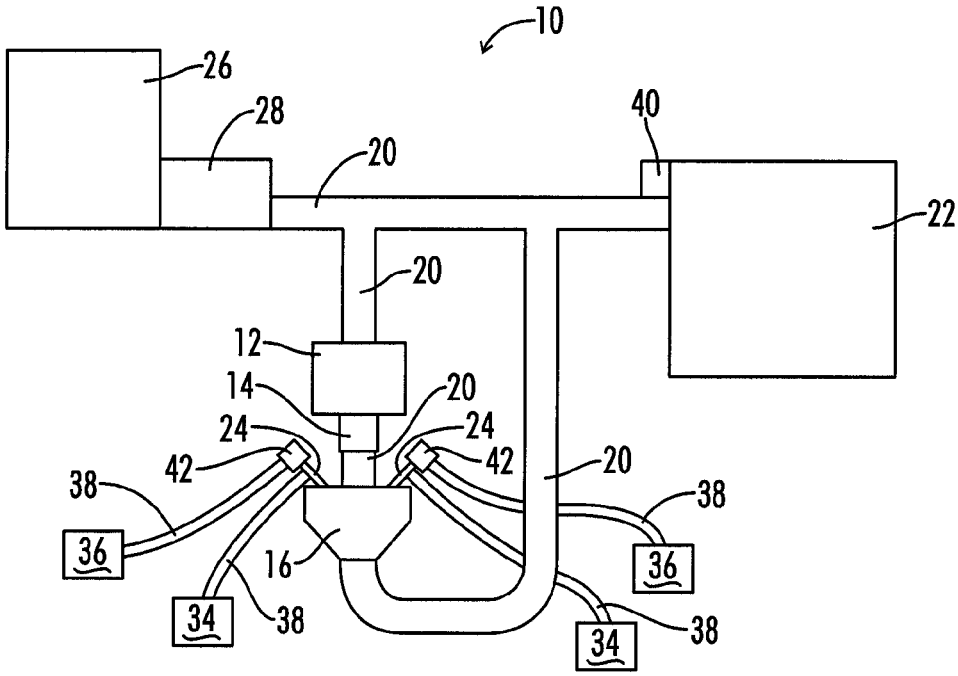
FIG. 2 is a schematic drawing of another embodiment of the fly ash treatment system for use at a coal-burning power plant. Specifically, as the ash is produced in the boiler and travels through the precipitator into the transportation pipe, the fly ash is diverted into the system for treatment with a sacrificial agent. Subsequent to treatment, the treated fly ash is reintroduced into the transportation pipe and transferred to the silo for storage.

Referring now to FIG. 1, there is shown a first embodiment of a fly ash treatment system 10. Shown is a system 10 including a first storage chamber 12, rotary feeder 14, treatment chamber 16, transportation pipe 20, second storage chamber 22, and nozzle 24. The first storage chamber 12 merely receives the fly ash from a power plant, or from a precipitator 28, as shown in FIG. 2. The first storage chamber 12, also known as a silo, may have a device for delivering rifle shots of air to assist in fluidizing the fly ash for movement of the fly ash therethrough. Also shown in FIG. 1 are the support members 32 which provide the framing to hold the system 10 as shown. Alternate embodiments may also include air nozzles or fluidizers to assist in the movement of the fly ash through the silo. The storage chamber 12, or silo, is constructed of material well known in the art for the temporary storage, or long term storage, of fly ash.

The amount of fly ash present in the transportation pipe 20 at any given time is related to the system's 10 ability to equally and consistently apply the sacrificial agent while the fly ash moves through the transportation pipe 20. One important aspect of the invention is that the sacrificial agent and fly ash continue to mix in the transportation pipe 20. In order to allow sufficient mixing, the transportation pipe 20 may be at least 10 feet in length. Also, since the cross sectional area of the transportation pipe 20 is related to the application of the sacrificial agent to the fly ash, the amount of such cross sectional space may vary. In certain embodiments, the cross sectional area of the transportation pipe 20 may be that of a pipe having a diameter of at least one inch. In still other embodiments, the cross sectional area of the transportation pipe 20 may be that of a pipe having a diameter of from about one inch to about 15 inches. In still other embodiments, the cross sectional area of the transportation pipe 20 may be that of a pipe having a diameter of from about four inches to about 12 inches. In other embodiments, the diameter of the pipe may be from about four inches to about five inches. Given the disclosure herein, one of ordinary skill in the art may modify the diameter or a cross sectional space of the transportation pipe 20 in order to accomplish the treatment characteristics disclosed herein.

Still referring to FIG. 1, shown there is the treatment chamber 16 of the present system 10. The treatment chamber 16 may be constructed of any rigid material and the size may vary as described herein. In certain embodiments, the treatment chamber 16 may include a conical shaped chamber having at least one chemical nozzle 24. The treatment chamber 16 allows the chemical nozzle 24 to deliver a predetermined chemical without the nozzle 24 entering the path of the fly ash. Any chemical nozzle 24, or other dispensing device, which is placed in the path of the fly ash will be damaged over time due to the constant abrasion provided as the fly ash travels across the device. Accordingly, as best seen in FIG. 8, the nozzles 24 are offset in the wide end of the conical shaped treatment chamber 16. In certain embodiments, the treatment chamber 16 may have 2, 3, 4, 5, 6, 7, or 8 chemical nozzles 24 so that a mixture of chemicals may be delivered at a given time, or so that a greater number of nozzles 24 may be used when delivering larger volumes of chemical entities. The amount of chemical entity to be used for a treatment is easily calculated by a user based upon the specific chemical entity being applied and the characteristics of the fly ash to receive the treatment.

Multiple nozzles 24 may be inserted in to the treatment chamber 16 in order to apply the sacrificial agent to the fly ash. In still other embodiments, nozzles 24 may be placed in a plurality of locations in order to apply the sacrificial agent from a plurality of locations. The nozzle 24 releases the sacrificial agent as a spray, mist, gas, or the like. The sacrificial agent may be forced through the nozzle 24 under air pressure of at least 40 PSI. In certain embodiments, the sacrificial agent may be under air pressure of from about 40 PSI to about 80 PSI. Such nozzles 24 are well known in the industry and widely commercially available.

The nozzle 24 is attached to tubing 38 leading to a compressed air 34 source, chemical reservoir 36, and chemical pump 42. The chemical reservoir 36 holds the sacrificial agent which is to be applied to the fly ash. In certain embodiments, the chemical reservoir 36 may be referred to as a tank 62. The chemical pump 42 pumps the proper amount of the sacrificial agent to the nozzle 24. The compressed air 34 is used to nebulize, fog, or mist the sacrificial agent from the liquid state in which it exists in the chemical reservoir 36, or tank 62. The PSI of the compressed air 34 is adjustable in order to optimize the delivery of the sacrificial agent. Compressed air 34 sources are well known in the art and readily commercially available. An example is a 15 horsepower air compressor, commercially available from Sullair Corporation, 3700 East Michigan Blvd., Michigan City, Mich. 46360. The chemical reservoir 36 may be a chemical storage tank, or other chemical storage device, as known in the industry, which are readily commercially available. Chemical pumps 42 are well known in the art and are readily commercially available.

Still referring to FIG. 1, the transportation pipe 20 transports the treated fly ash to a second storage chamber 22 via a silo member 35 to collect the treated fly ash. It is noteworthy that mixture of the sacrificial agent and the fly ash may continue during transportation of the fly ash through the transportation pipe 20. The transportation pipe 20 may be constructed of any rigid material and such transportation pipes 20 are well known in the industry and readily commercially available. An example of a second storage chamber 22 is a silo for storing treated fly ash which is waiting to be shipped or otherwise used. Such a second storage chamber 22 may include a 4,000 ton silo. In certain embodiments, an alternate vacuum or compressed air 34 source may be used to facilitate transportation of the treated fly ash from the treatment chamber 16 to the second storage chamber 22. Examples of such air pressure systems include the systems of coal-burning power plants, and pressure systems for pneumatic trucks. Such vacuum sources, or compressed air 34 sources are well known in the industry and readily commercially available. In certain embodiments, the transportation pipe 20 is plumbed to the load out silo. Alternately, certain embodiments may include a bag house 40 in order to vent the air pressure from the system 10 and allow the treated fly ash to collect in the second storage chamber 22.

Referring now to FIG. 2, there is shown an embodiment of the present system 10 which may be used in association with a currently existing coal-burning power plant. With reference to power production in general, and in the absence of the present invention, coal is burned in a boiler 26, the air is vented and the ash travels through an electrostatic precipitator 28. The ash then travels to a transportation pipe 20, having air movement due to a vacuum or a compressed air 34 source, so that the ash is transported to a storage silo, referred to herein as a second storage chamber 22. In the absence of the present invention, the fly ash which is stored in the silo, also called second storage chamber 22, has not been treated and may contain reactive carbon.

The embodiment of the system 10 shown in FIG. 2 allows treatment of fly ash with a sacrificial agent at a rate which may be predetermined by the user. In certain embodiments, the system 10 may "tap into" a transportation pipe 20 of an existing power plant in order to redirect the untreated fly ash through the presently disclosed system 10 and allow collection of the treated fly ash in a storage silo, also called a second storage chamber 22.

Shown in FIG. 2 is the path which fly ash travels upon treatment with the present system 10. From the precipitator 28, there is a transportation pipe 20 leading to a first storage chamber 12. In this embodiment, there is a plumb line to the load out silo. Once fly ash is received in the first storage chamber 12, a rotary feeder 14 moves it into the transportation pipe 20. A sacrificial agent is applied to the fly ash within the treatment chamber 16 by use of chemical nozzles 24, attached to tubing 38 leading to a compressed air 34 source, chemical reservoir 36, and chemical pump 42. Then, the treated fly ash and sacrificial agent travel through the transportation pipe 20 to the second storage chamber 22. Once received at the second storage chamber 22 the fly, ash is stored until transported or until used.

Figure 3:
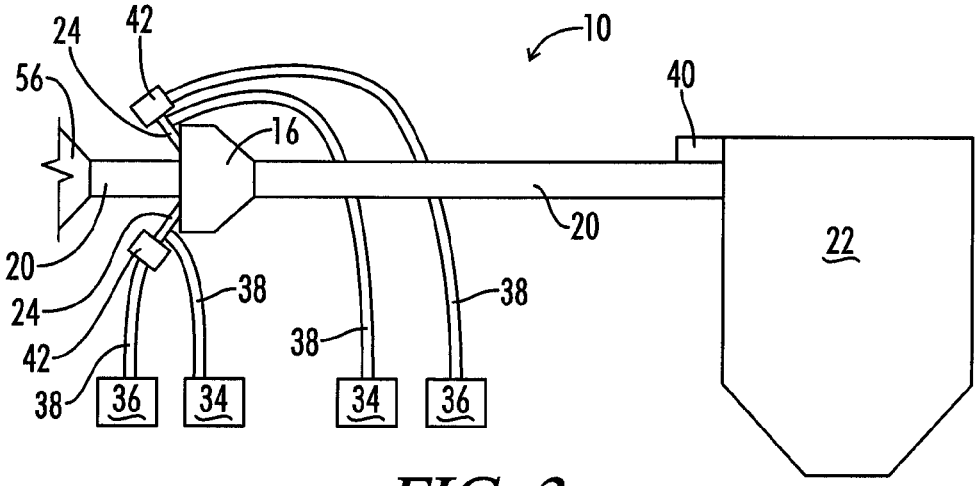
FIG. 3 is a schematic drawing of an embodiment of a fly ash treatment system for use when unloading a pneumatic truck. The opening of the truck is shown. The fly ash passes through a first segment of the transportation pipe and into the treatment chamber for application of the sacrificial agent. Then, the sacrificial agent and fly ash continue to mix in the second segment of the transportation pipe as they are transported to the silo.

In addition to treatment at the coal-burning power plant, treatment may occur at a concrete production plant. Specifically, treatment may occur as the fly ash, being transported from the power plant to the concrete plant, is unloaded from the pneumatic truck. Accordingly, in one embodiment, the rate of treatment disclosed herein may be from about 900 lbs/minute to about 1100 lbs/minute. As best seen in FIG. 3, the system 10 for such an embodiment may include a transportation pipe 20, a treatment chamber 16 having at least one chemical nozzle 24, attached by tubing 38, or other means, to a chemical pump 42, a compressed air source 34, and a chemical reservoir 36. The system 10 may attach to the unloading opening 56 of a pneumatic truck, or other transportation vehicle, so that while the fly ash is unloading to the silo, or second storage chamber 22, it is treated with the sacrificial agent.

Figure 4:
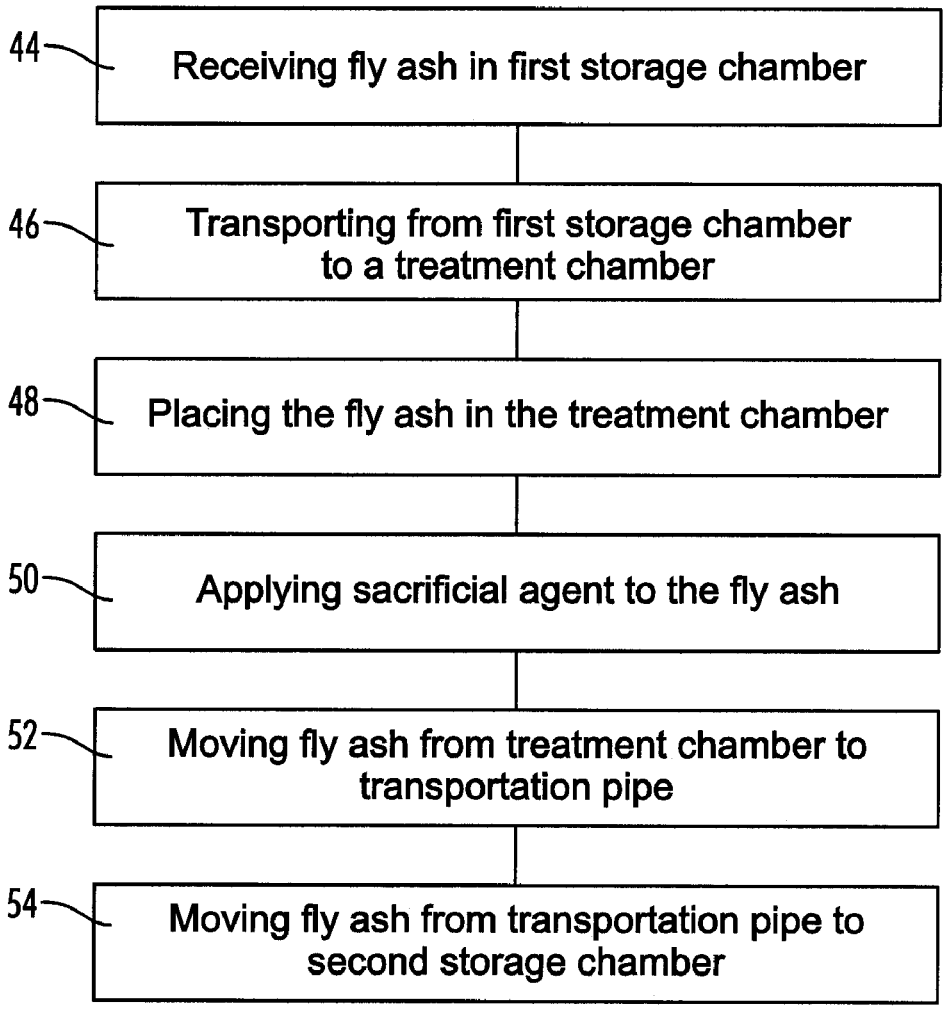
FIG. 4 is a flow diagram showing the steps of an embodiment of the current invention.

Referring now to FIG. 4, there is shown a flow diagram for an embodiment for the method of treating fly ash as it is produced at a coal burning power plant. The first embodiment of the method includes the steps of receiving 44 fly ash in the first storage chamber 12, transporting 46 the fly ash from the first storage chamber 12 to a treatment chamber 16, placing 48 the fly ash in the treatment chamber 16, applying 50 a sacrificial agent to the fly ash, moving 52 fly ash from the treatment chamber 16 to the transportation pipe 20 and moving 54 fly ash from the transportation pipe 20 to a second storage chamber 22.

In certain embodiments, the rate of transportation of fly ash through the transportation pipe 20 may be within the range from about 500 lbs/min to about 2,500 lbs/min. In alternate embodiments, the method of treating fly ash may occur at a rate which is at least 500 lbs/min. In still other embodiments, the rate of transportation of fly ash through the transportation pipe 20 may be within the range from about 1000 lbs/min to about 5000 lbs/min.

Figure 5:
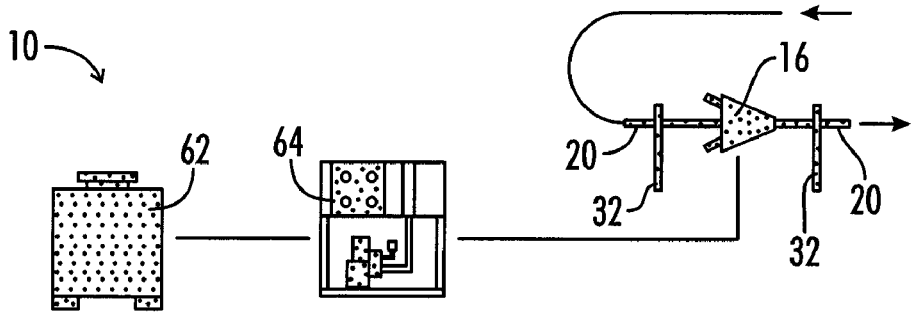
FIG. 5 is a schematic drawing of an embodiment of the fly ash treatment system. Shown therein is the tank module, metering module, and injector module.

Referring now to FIG. 5, there is shown another embodiment of the present invention. As shown therein, this embodiment of the system includes at least three modules. First, chemical entity storage chamber 62, or tank 62, is used to store the chemical entity to be used to treat the fly ash. Like the chemical reservoir 36, this holds the chemical entity to be applied. An example of a chemical entity storage chamber 62 is a 350-gallon portable and returnable container. Large tanks 62 such as this may be placed by a forklift and attached to the remainder of the system by quick-disconnect fittings and hoses. Alternatively, permanent tanks 62 may be used. Such permanent tanks 62 may have a capacity of 4,000 to 10,000 gallons. In colder climates, tanks 62 may require heat and/or insulation.

Still referring to FIG. 5, the second module of this embodiment is a metering module 64. The metering module 64 is a chemical pump 42 which may be adjustable for the accurate dispensing of a chemical entity. An example of the chemical pump 42 is a rotary vane chemical metering pump, commercially available from Jackson Machine Co., Yorkville, Ill., with a brass-body pump having carbon graphite vanes and liner. Such a pump operates at up to 1750 RPM and includes an internal pressure relief system. It is powered by a General Electric, NEMA 56C-frame, ½ horsepower, 0-90 VDC, PM motor. The chemical pump 42 may include a motor, electrical controls, and piping, or hose, system. This metering module 64 is operationally connected to the tank 62 and the treatment chamber 16, as further described below. Operation of the metering module 64 in colder climates may require heat and/or insulation.

Shown within FIG. 5 is the third module of this embodiment is the injector module. The injector module includes the treatment chamber 16, piping sections having nozzles 24 for the distribution of the chemical entity evenly into the fly ash which is moving through the system. Compressed air is required to provide optimal atomized injection of the chemical entity. Detailed descriptions of embodiments of the injector module are found throughout this document.

Still referring to FIG. 5, schematic drawings are shown to represent the embodiment of the system 10. Additional detailed drawings, showing the operational connections of the invention, are shown in subsequent figures. Examples of the operational connections for the transportation of fly ash or the chemical entity through the system 10 are well known to those of skill in the art. Specific examples of such hoses, connections, and accessories which may be used with the present invention include pressure switches, remote start units, check valves, portable tank adapters and valves, chemical transfer hose assemblies, air hose supply assembly, chemical injection hose assemblies, and the like. These items are widely commercially available and well known to those of skill in the art. Additional accessories that may be used for connection of the system 10 may include tank basins, pump basins, hose basins, sorbent drums, and the like. These items, too, are widely commercially available. Connection and assembly of the modules of the system 10 are described herein, in addition to one of ordinary skill being familiar with the types of connections needed for the transportation of fly ash and chemical entity through the system 10.

Referring now to FIG. 6, there is shown a top view of an embodiment of the present invention. The invention includes a control panel 80, first fluid conduit 82, second fluid conduit 84, third fluid conduit 86, valve 88, chemical pump 42, totalizer 90, pressure gauge 73, first visual flow detector 94, second visual flow detector 96, and strainer. A chemical entity located in the tank 62 is transported by a chemical pump 42 through a first fluid conduit 82. The first fluid conduit 82 attaches to a second fluid conduit 84 to transport the chemical entity to the in-line heater 100 and to a valve 88. The user, by manipulating the valve, determines whether the chemical entity is directed toward the tank 62 through the second fluid conduit 84, or to the treatment chamber 16 for delivery. If the chemical entity is directed to the treatment chamber 16, then a third fluid conduit 86 carries it to the nozzles 24. The nozzles 24 are inserted in the treatment chamber 16, as best seen in FIG. 8, and attached by use of a quick release fitting 76, or the like. As shown in FIG. 6, the third fluid conduit 86 attached to the nozzles 24 is not attached to the treatment chamber 16. FIG. 8, further described below, shows such attachment of the nozzles 24 to the treatment chamber 16. In certain embodiments, the capacity of the chemical pump 42 may be up to 18 gallons per hour, at 350 PSI. An example of the chemical pump 42 is the Neptune 535-A-N1, commercially available from Neptune Chemical Pump Company, of Lansdale, Pa. 19446. Totalizers 90 are used to measure chemical flow and are widely commercially available from a company such as GPI Inc. In certain embodiments, the invention includes an ambient heater 98. An example of such an ambient heater 98 is the Hoffman 800 watt space heater with thermostat. In still other embodiments, the invention may include an in-line heater 100 to heat the chemical entity as it circulates through the first fluid conduit 82 and second fluid conduit 84. Such heaters are well known and widely commercially available. An example of the in-line heater 100 is the 1100 watt Accu-Therm cartridge heater with thermostat.

Referring now to FIG. 7, there is shown a side view of an embodiment of the present invention. The control panel 80, which is further described below, is largely used to operate the invention. The control panel 80 may have a manual control or a remote start capability. Obviously, remote operation requires additional wiring. The chemical pump 42 runs on standard voltage 120VAC, 60 HZ. In certain embodiments, the control panel 80 includes a DC-SCR variable speed motor drive 102, also called a rate controller for the chemical pump 42, circuit breakers, wiring, and terminal strips. The rate controller 102 may be located within the control panel 80 or adjacent to the chemical pump 42. In certain embodiments, devices for visual confirmation of chemical entity flow, herein called first and second visual flow detectors 94, 96, respectively, are present for the movement of the chemical entity during recirculation and for the chemical entity being pumped to treat the fly ash. Examples of such devices include paddle wheel type displays, or other forms of visual confirmation. Each element of the module is widely commercially available and is assembled and operationally connected as shown and described herein. In certain embodiments, the invention may be a free standing and enclosed structure which is operational under various weather conditions. Such an embodiment may be used at a power plant facility with changes, as known to those of ordinary skill in the art, for scaling up the embodiment to handle such capacity. For example, the invention may be a portable housing which may be lifted by forklift, or equivalent, and is constructed from a stable and rigid material such as steel, other metal, or the like. In other embodiments, as the one shown in FIGS. 6 and 7, the system 10 may be mounted on a base 104 for transportation in a vehicle, for example a van, in order to function as a mobile unit.

Still referring to FIG. 7, in certain embodiments, the capacity of the chemical pump 42 is from about 0.7 to about 18 gallons per hour and operates at pressures up to 350 PSI. The chemical pump 42 may be adjustable to allow modification of the capacity from 10% up to 100%. Such pumps are widely commercially available, for example the Neptune 500 Dia-Pump, from Neptune Chemical Pump Company, of Lansdale, Pa. 19446. Regarding the piping system of the metering module 64, that system may include an inlet ball valve, strainer, calibration cylinder and valve to check pump output, tube fittings, bleed valve, and pressure gauge. One of ordinary skill in the art knows of suitable pipe, tube, hose, and fittings for the temperature, pressure, and fluid characteristics under which the pump is used. For example, inlet side piping should be as short and large as possible to keep resistance to flow minimized. A "flooded suction" is recommended. One of ordinary skill in the art is familiar with the start up, calibration, and maintenance of such pumps.

Referring back to FIG. 6, there is shown an embodiment having an ambient heater 98 and an in-line heater 100. When the ambient temperature is below 50 degrees F., it has been noted that chemical entities may increase in viscosity. A consequence of increased viscosity is a change in flow rate which may result in inaccurate dosing. Accordingly, certain embodiments include an in-line heater 100, also called an immersion heater, and temperature gauge. In certain embodiments, a ¾ inch hose is used to make the connections. The thermostat of the heater 100, a heating element, may be set as desired. In certain embodiments, it may be desirable to set the temperature at about 80 degrees F. Also shown in the figure are the operational connections 75 from the control panel 80, which are further described below.

As stated elsewhere in this document, the sacrificial agent, or chemical entity, may be one of those entities known in the art to accomplish the functions described herein.

Still referring to FIGS. 6 and 7, the various fluid conduits may include ¾ inch piping. Alternatively, the fluid conduits may include ½ or ¼ inch piping. Pneumatic pressure through a ½ pipe provides the force to atomize the chemical entity for delivery to the flowing fly ash.

Referring now to FIG. 8, there is shown a side view of an embodiment of the present invention. In certain embodiments, the treatment chamber 16 and transportation pipe 20 may be positioned parallel to the tank 62, as shown in the figure. In alternate embodiments, the treatment chamber 16 and transportation pipe 20 may be positioned perpendicular to the tank 62, or as otherwise desired by the user based upon the positioning of the components to which the transportation pipe 20 attach. The shown embodiment of the invention is controlled by the control panel 80. The control panel 80 is operationally connected to the components shown. The operational connections 75, for example power cords, provide power to the shown components through the control panel 80, as known by those of ordinary skill in the art. In order to use the invention, after a power supply is provided, the power switch 106 is turned on. When on, a pilot light 108 may glow for confirmation. A second pilot light 110 may be used to confirm that the chemical pump 42 is running. A selection 112 on the control panel 80 determines whether a remote controlled unit may operate the invention. A selection of "remote" or "local" is made. Selection of "remote" just means that the chemical pump 42 may be started or stopped with a remote control. Remote control technology is well known to those of skill in the art. The control panel 80 allows for the ambient heater 98 or the in-line heater 100 to be turned on and set to a predetermined temperature, by use of the heater selection 114. In certain embodiments, the temperature of the ambient heater 98 or in-line heater 100 may be set on the heater itself. The control panel 80 allows for the operation of the compressed air source 34 to be interlocked with the operation of the chemical pump 42 when the dial 116 is set. When interlocked, if air pressure is low, the chemical pump 42 may not operate. When not interlocked, the chemical pump 42 may operate regardless of the air pressure generated by the compressed air source 34. Finally, the control panel 80 provides a pump speed control 118 which allows for the selection of a percentage of available RPM of the chemical pump 42 to adjust the chemical entity flow of the invention.

When treating fly ash from a pneumatic truck, connection of the transportation pipe 20 to the standard hoses of the pneumatic truck are made as known in the art. After the power is turned on for the system 10, selection 112 is made for "remote" or "local", the compressed air valve 77 is opened to allow the system 10 to be pressurized, and the chemical delivery valve 88 is opened for delivery of the chemical entity. Confirmation of delivery of the chemical entity is available by viewing the movement of the second visual flow detector 96. The specific rate of chemical entity delivery is controlled by the rate controller 102 for the chemical pump 42. The totalizer 90 tracks the total volume of chemical entity delivered during a specified period. The rate to use for chemical entity delivery is calculated by knowing the amount of fly ash to be off loaded from the pneumatic truck in a given period of time, as known by those of skill in the art. For example, when a user knows the volume of chemical entity to be applied per ton of fly ash, the number of tons of fly ash to be off loaded from the pneumatic truck, and the amount of time required to offload the specified number of tons, then the rate of delivery of the chemical entity is also known.

Still referring to FIG. 8, the chemical entity stored in the tank 62 may be delivered to the treatment chamber 16 when the user so desires. The user controls the rate of delivery of the chemical entity. By way of example, the chemical entity is pumped from the tank 62 by a chemical pump 42. The chemical entity travels via the first fluid conduit 82, through the chemical pump 42 and into the second fluid conduit 84. The second fluid conduit 84 leads to the in-line heater 100, first visual flow detector 94, and valve 88. The user determines whether the valve 88 directs the chemical entity to the second fluid conduit 84 or the third fluid conduit 86. The second fluid conduit 84 leads to the tank 62, such that the chemical entity is recirculated through the system 10. The third fluid conduit 86 leads to a second visual flow detector 96, totalizer 90, and nozzles 24 which are placed in the treatment chamber 16. Also shown in the figure are a temperature gauge 74 for checking the temperature of the chemical entity, a rate meter 72 for determining the flow rate of the chemical entity, and pressure gauge 73 for determining the pressure provided by the compressed air source 34. Further, the figure shows the nozzles 24 housed within the treatment chamber 16. The embodiment shown uses two nozzles 24, however, more could be used. The chemical entity is disbursed by the nozzles 24 as the fly ash travels through the transportation pipe 20 in the direction indicated by the arrows. Also shown is a drain line 78 to allow drainage from the third conduit 86, such as when chemical treatment is complete and the system is being cleaned.

Figure 9:
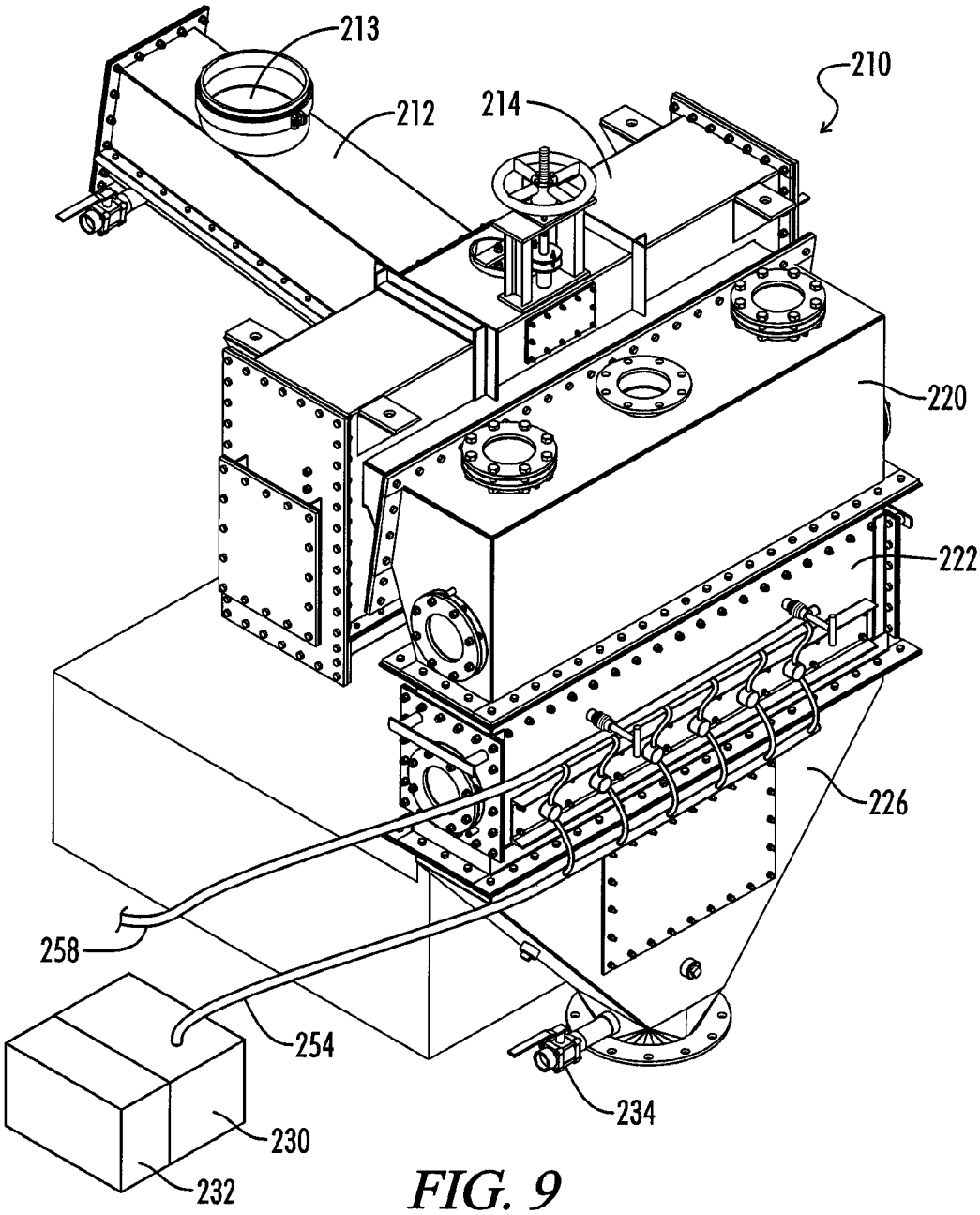
FIG. 9 is a perspective view of an embodiment of the material treatment system disclosed herein. Shown there are the conduit, fluidized bed chamber, discharge chamber, application chamber, and concentration chute.

Referring now to FIG. 9, there is shown a perspective view of an embodiment of the material treatment system 210. The material 260, such as fly ash, cement, slag, or the like, enters the first opening 213 of the conduit in a dense phase in which the material 260 is originally found. An example of a material 260 in a dense phase is fly ash as it is found in a silo at a coal burning power plant. The material 260 then enters the fluidized bed chamber 214 wherein the material 260 is transitioned into a dilute phase, as further described herein. The material 260 then enters the discharge chamber 220 and is in a gravitational free fall during the transition from the discharge chamber 220 to the application chamber 222. It is during the gravitational free fall that the material 260 receives the chemical entity 262 within the application chamber 222. While the material 260 is in the gravitational free fall, it is in a truly dilute phase. Subsequent to application of the chemical entity 262, the material 260 transitions from the application chamber 222 to the concentration chute 226. It is within the concentration chute 226 that the material 260 is transitioned from the truly dilute phase back to the dense phase, whereupon it exits the concentration chute 226.

Figure 10:
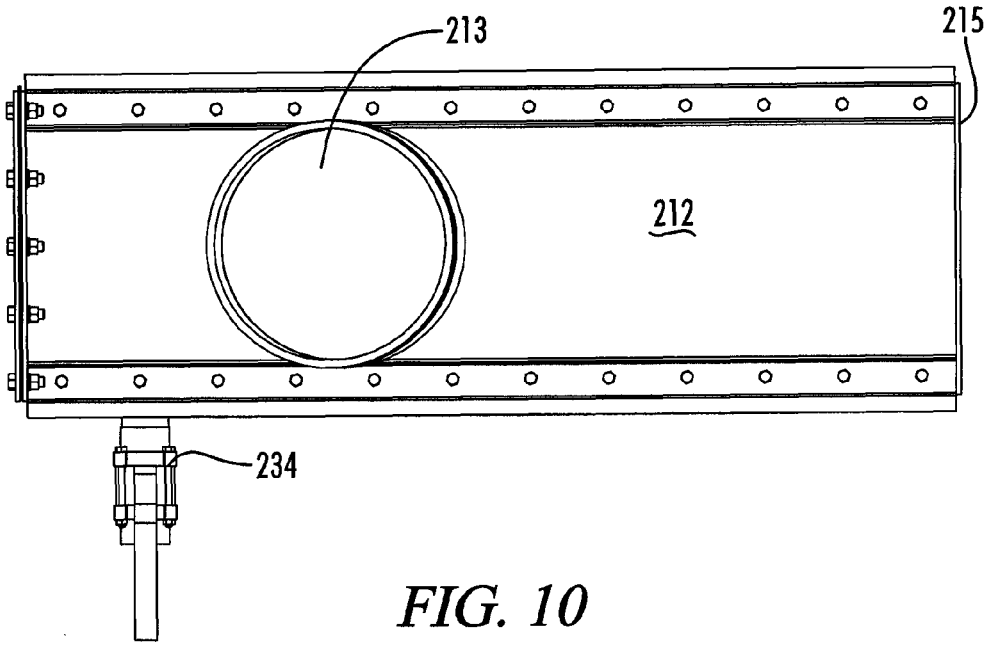
FIG. 10 is a top view of an embodiment of the conduit which initially receives the material to which the chemical entity is to be applied.
Figure 11:
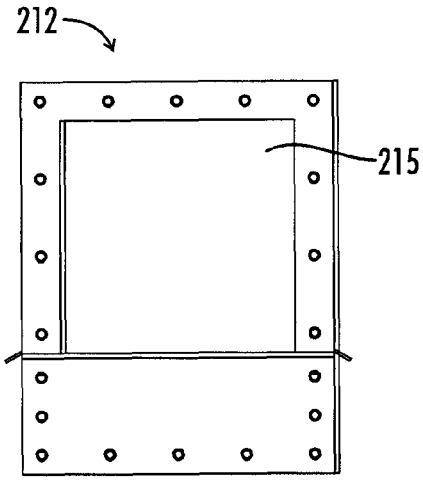
FIG. 11 is an end view of an embodiment of the conduit showing the second opening of the conduit which is in fluid connection with the fluidized bed chamber.
Figure 12:
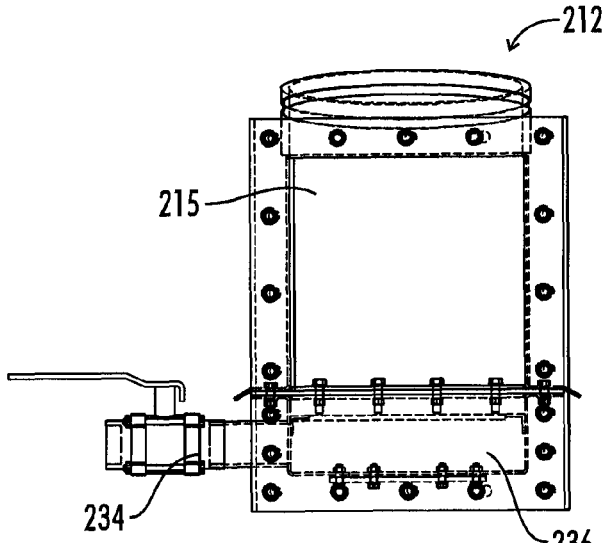
FIG. 12 is an end view of an embodiment of the conduit with broken lines showing the internal parts. Shown there is the second opening of the conduit as well as the air supply channel located beneath which is used to assist the movement of materials through the conduit.

Referring now to FIG. 10, there is shown a top view of the conduit 212, also called an air chute, which shows the first opening 213 and second opening 215 of the conduit 212. In certain embodiments, movement of the material 260 through the conduit 212 is assisted by use of an air supply and appropriate air supply connectors 234. FIG. 11 shows an end view of the second opening 215 of the conduit 212. In certain embodiments, the first opening 213 may be a circular opening with a diameter of from about six inches to about 12 inches. The specific shape of the openings described herein is not as relevant as the cross sectional area provided thereby. Accordingly, the embodiment shown provides a rectangular second opening 215. FIG. 12 is an altered view of FIG. 11 in order to show the attachment of the air supply connector 234 as well as the air supply channel 236 though which air moves in order to promote the movement of material 260 through the conduit 212. As seen in FIGS. 9-22, in certain embodiments, air supply connectors 234 and air supply channels 236 promote the movement of material 260, such as fly ash, cement, slag, or similar powder materials, and such air flow or pneumatic conveyance systems are well known to those of skill in the art.

Figure 13:
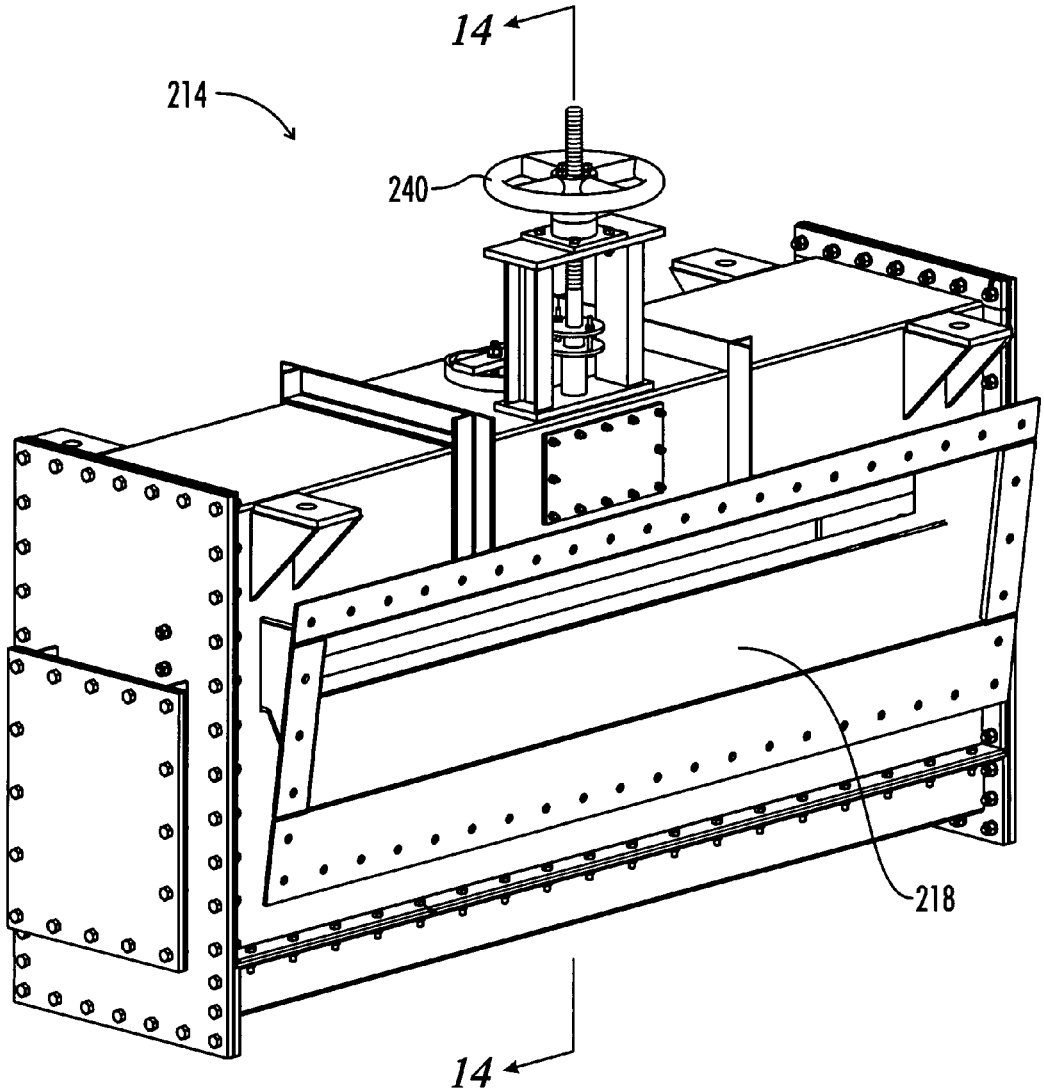
FIG. 13 is a perspective view of an embodiment of the fluidized bed chamber of the present invention. Shown there is the second opening of the fluidized bed chamber and the hand wheel used to adjust the positioning of the deflection gate, which is best seen in the next figure.
Figure 14:
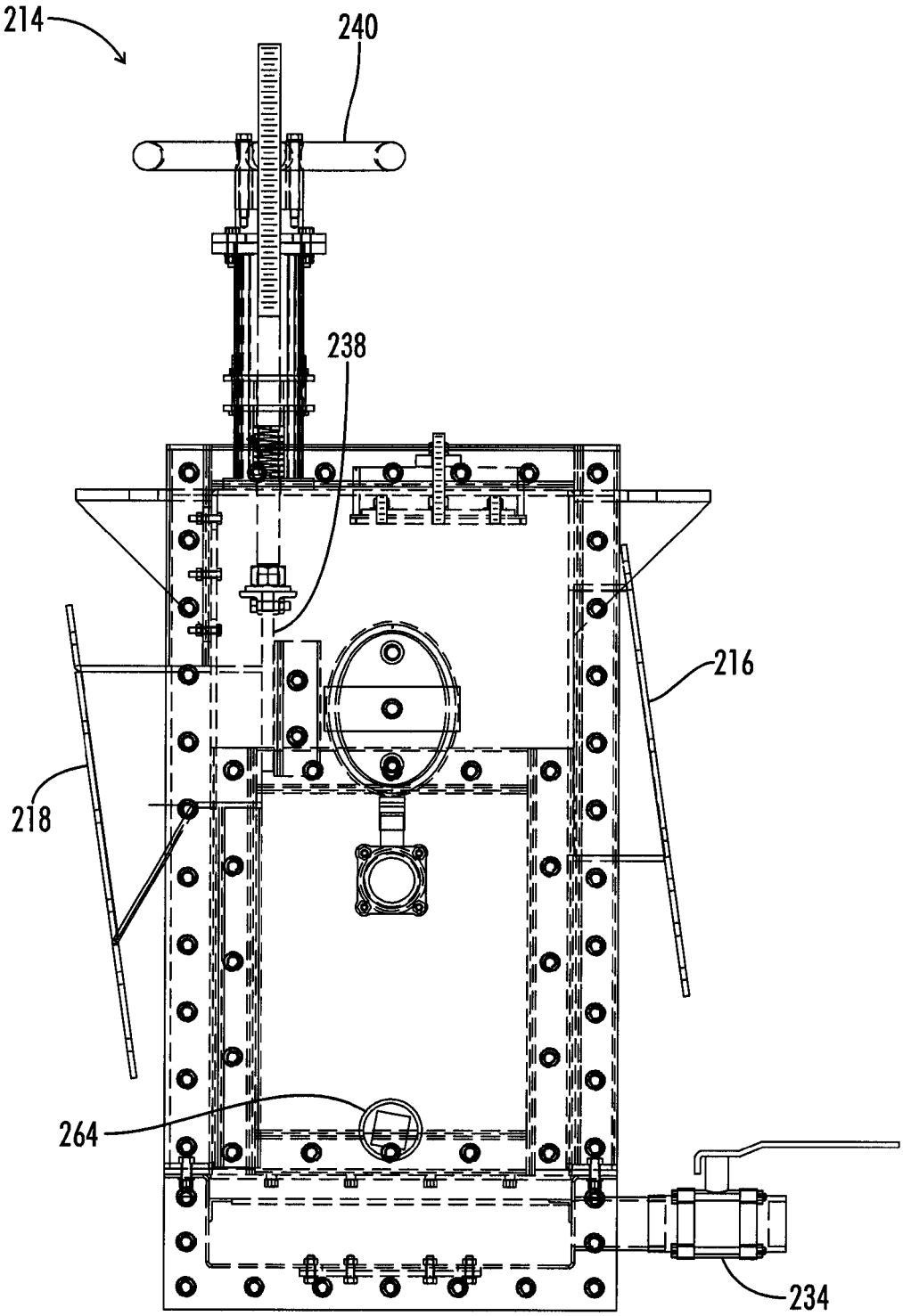
FIG. 14 is a cross sectional view along line 14-14 of FIG. 13 of an embodiment of the fluidized bed chamber with broken lines showing the portion of the fluidized bed chamber that would be in the foreground. Shown there is the deflection gate which is used to help spread the materials the width of the fluidized bed chamber such that the materials enter a dilute phase from a dense phase.

Shown in FIG. 13 is a perspective view of the fluidized bed chamber 214 showing the second opening 218 through which the material 260 exits the fluidized bed chamber 214 in a dilute phase. In certain embodiments of the present invention, the width of the fluidized bed chamber 214 is determined by the amount of space available at the facility and may be greater than other embodiments disclosed herein. In certain embodiments, the width may be 70 inches or more. In alternate embodiments, the second opening 218 may be from about 50×12 inches to about 70×12 inches. Referring now to FIG. 14, there is shown a cross sectional view along line 14-14 of FIG. 13 with broken lines showing the portion of the fluidized bed chamber that is would be in the foreground if not for the cross section. Shown there is the first opening 216 through which the material 260 enters the fluidized bed chamber 214, and the second opening 218 which allows its exit. As the material 260 moves through the fluidized bed chamber 214, it travels over the deflection gate 238 which may be adjusted by the hand wheel 240, specifically, the deflection angle. In certain embodiments, the hand wheel 240 may be used to open and close the horizontal channel leading from the fluidized be chamber 214 to the discharge chamber 220. In certain embodiments, the deflection distance of the deflection gate 238 is from about 5 inches to about 10 inches. In certain embodiments, the deflection gate 238 is used to help evenly spread the material 260 across the width of the fluidized bed chamber 214 so that it enters the discharge chamber 220 in a generally even manner, in order to transition the material 260 from a dense phase to a dilute phase. The material treatment system 210 disclosed herein may be constructed of any suitable material to accomplish the function disclosed herein. In certain embodiments, the system 210 may be constructed of any rigid material, such as metal, steel, or the like, the different chambers, such as fluidized bed chamber 214, discharge chamber 220, and the like, may be constructed independently and attached by use of appropriate fasteners, such as nuts and bolts, as known by one of ordinary skill in the arts. In certain embodiments, the chambers which may require openings, sample ports, or the like, such openings may be placed in the chambers at the stated position as is known by one of ordinary skill in the art of metallurgy.

Figure 15:
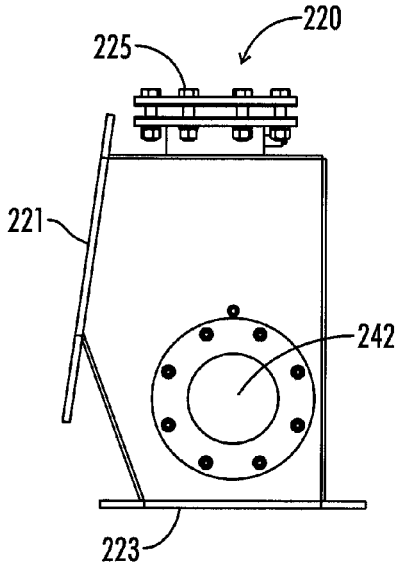
FIG. 15 is a side view of an embodiment of the discharge chamber. Shown there are the openings through which the materials enter and exit. Also shown is an observation window.
Figure 16:
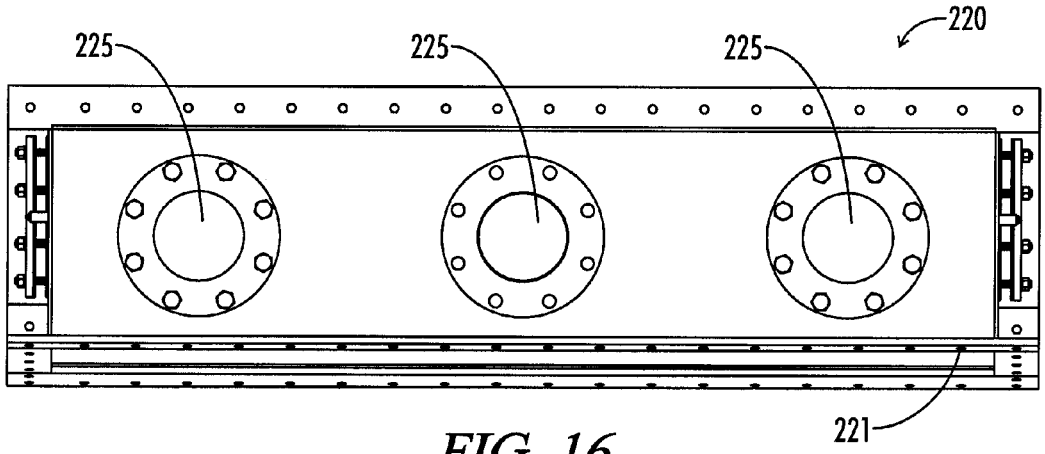
FIG. 16 is a top view of an embodiment of the discharge chamber. Shown there are the several vent openings which may be opened to allow the ventilation of dust while materials are flowing through the discharge chamber.

Referring now to FIG. 15, there is shown a side view of the discharge chamber 220. Shown there is the first opening 221 and the second opening 223, through which the material 260 travels through the discharge chamber 220. Also shown is the vent opening 225 which may be opened to allow ventilation of dust or appropriate routine inspection, or the like as the material 260 travels through the discharge chamber 220. In certain embodiments, the discharge chamber 220 may include a view window 242 to allow observation of the material 260 as it passes through the discharge chamber 220. In certain embodiments, the discharge chamber 220 is a conduit to allow transportation of the material 260 from the fluidized bed chamber 214 to the application chamber 222. Referring now to FIG. 16, there is shown a top view of the discharge chamber 220. In the embodiment shown, there are three vent openings 225.

Figure 17:
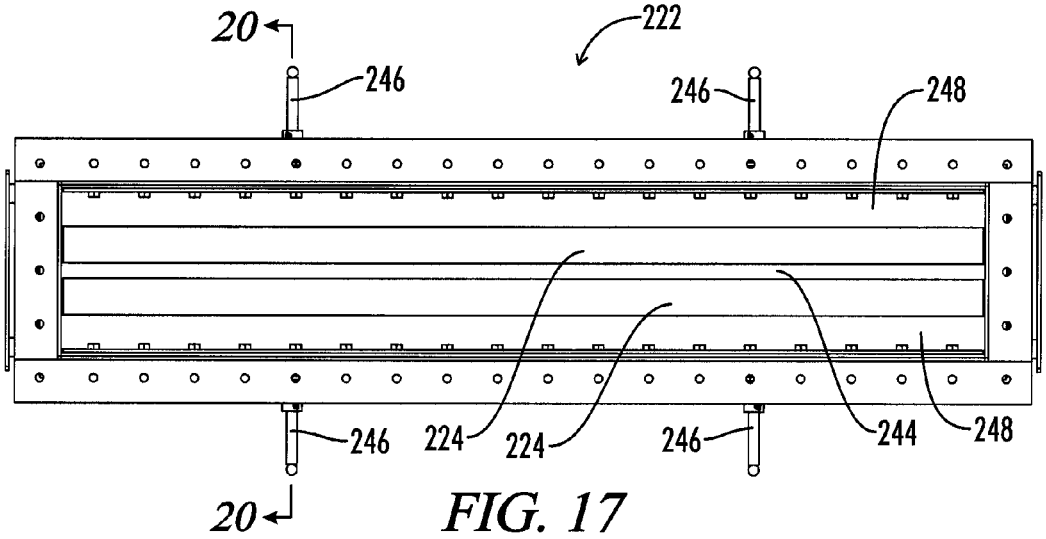
FIG. 17 is a top view of an embodiment of the application chamber. Shown there is the first opening of the application chamber through which materials travel. The adjustable baffles which are shown guide the materials into a predetermined flow path as they travel through the application chamber.
Figure 18:
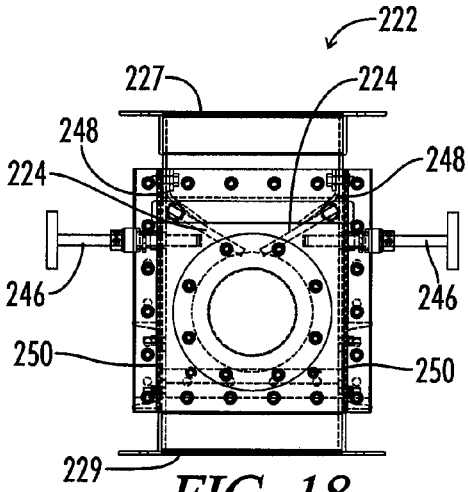
FIG. 18 is an end view with broken lines showing the internal parts, showing an embodiment of the application chamber. Shown there are the adjustable baffles and the nozzle plates which provide the nozzles for the delivery of the chemical entity to the material passing through the application chamber.

Referring now to FIG. 17, there is shown a top view of the application chamber 222. When looking down through the first opening 227 of the application chamber 222, the flow path 244 through the application 222 is visible. The flow path 244 is flanked by the adjustable baffles 224. Those adjustable baffles are attached to the flexible siding 248 of the application chamber 222, so that the adjustable baffles 224 may be adjusted to alter the width of the flow path 244. In certain embodiments, a baffle adjustment device 246 may be used to easily and conveniently adjust the position of the adjustable baffles 224. In certain embodiments, the baffle adjustment device 246 may be a T-bar which physically engages the surface of each adjustable baffle 224 in order to position it, as best seen in FIGS. 17 and 18. Referring now to FIG. 18, there is shown an end view with broken lines showing internal parts. In the embodiment shown, the baffle adjustment device 246 physically contacts the adjustable baffle 224 in order to position it. Once each of the two adjustable baffles 224 are properly positioned, then the flow path 244 has a defined width. While the material 260 transitions from the adjustable baffle 224 through the remainder of the application chamber 222, those materials 260 are in a truly dilute phase. While in such a phase, the material 260 is most receptive to the application of a chemical entity 262. In order to maintain maximum versatility, in certain embodiments, the application chamber 222 may have a nozzle plate 250 attached to each side of the application chamber 222. In certain embodiments, the nozzle plate 250 has a predetermined number of nozzles for the release of a chemical entity 262 in order to apply the chemical entity 262 to the material 260 traveling through the application chamber 222. Accordingly, a first nozzle plate 250 may have only two or three nozzles in order to accommodate a specified flow rate of material 260 or type of material 260 which is traveling through the application chamber 222. In alternate embodiments, the nozzle plate 250 may have eight or more nozzles in order to accommodate a different flow rate of material 260 or type of material 260 being passed through the application chamber 222. In certain embodiments, the nozzle plate 250 may be physically attached to the application chamber 222 in a manner that is well known by those of skill in the art, such as by the use of fasteners. In still other embodiments, the nozzles may be attached directly to the application chamber 222, without the use of a nozzle plate 250. In certain embodiments, the chemical entity 262 may be any chemical, sacrificial agent, or the like, which may be applied to a material 260, such as fly ash, cement, slag, or the like. In other embodiments, the chemical entity 262 may be a chemical, or sacrificial agent used for the treatment of fly ash. In still other embodiments, the chemical entity 262 may be selected based upon the desires of the user. With reference to the chemical pump 230, in certain embodiments, it may be of a type having the capacity needed to apply a specific chemical entity 262 to a certain material 260 which is flowing at a predetermined rate, as determined by a user of the material treatment system 210. In certain embodiments, the chemical pump 230 and associated components needed to atomize the chemical entity 262, may be of the type and capacity described herein. In other embodiments, the chemical pump 230 and associated components needed to atomize the chemical entity 262, may be of the type and capacity known to those of skill in the art. In certain embodiments, for example, when treating fly ash, the flow rate of the fly ash is independent of the material treatment system 210. Accordingly, the capacity of the chemical pump 230, and associated components needed to atomize the chemical entity 262, as well as the number of nozzles, may be subject to the fly ash volume and flow rate.

Figure 19:
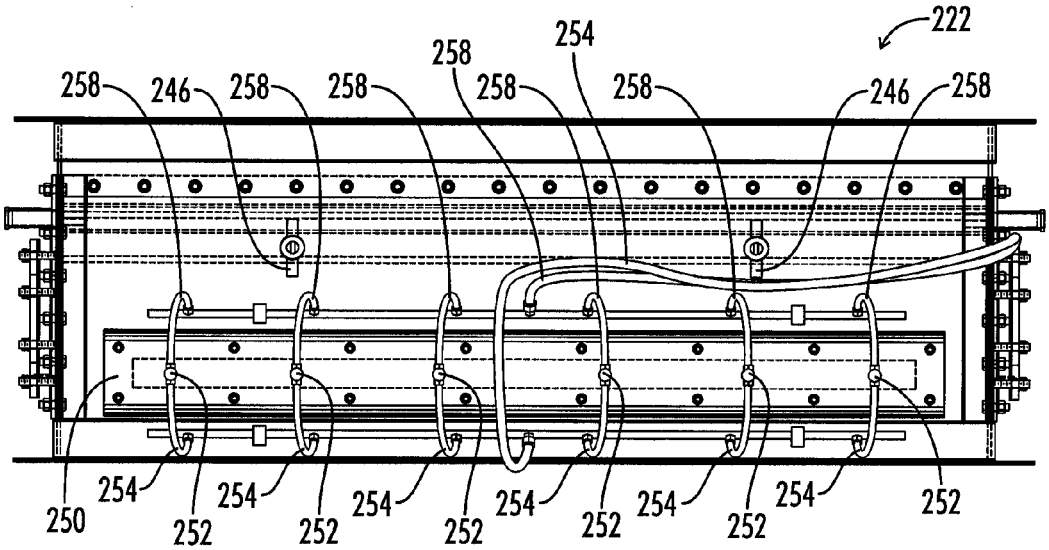
FIG. 19 is a side view of the application chamber showing the plurality of nozzle fittings for distribution of the chemical entity. Also shown are the chemical supply hose and air supply hose, which are needed to atomize the chemical entity during delivery. Broken lines show the internal parts.

Still referring to the application chamber 222, referring now to FIG. 19, there is shown an embodiment of the application chamber 222 having a nozzle plate 250 and nozzle fittings 252. A chemical pump 230 (not shown) pumps a chemical entity 262 through a chemical supply hose 254 to each of the nozzle fitting 252 for delivery by the nozzle 256 (not shown). In certain embodiments, such as the one shown, the chemical supply hose 254 may junction with another device in order to effectively supply a plurality of nozzle fittings 252. In certain embodiments, atomizing the chemical entity 262 being dispersed is accomplished by use of an air supply hose 258 to supply to the nozzle fittings 252 the air pressure needed to atomize the chemical entity 262 for delivery. In certain embodiments, the chemical supply hose 254 assembly and air supply hose 258 assembly are attached to the nozzle plate 250 such that attachment of the nozzle plate 250 to the application chamber 222, and connection of the supply hoses results in an operable treatment system 210. The chemical pump 230 may be of the type which is described herein. The supply hoses may be of the type that are well known in the industry for accomplishing the functions described herein. In certain embodiments, the chemical pump 230 is communicationally attached to a master flow controlling device 232, best seen in FIG. 9, so that the chemical pump 230 deceases or increases the rate of chemical flow in response to a signal from the master flow controlling device 232. For example, in the treatment of fly ash, the fly ash flow rate is independent of the material treatment system 210, so the flow rate is determined by an electronic signal generated by a truck scale, impact flow meter, rotary feed valve, or the like. Any such device sends a signal, in certain embodiments 4-20 mA analog output, to the master flow controlling device 232 which then signals the chemical pump 230 to increase or decrease the rate of chemical flow. An example of such a master flow controlling device 232 includes any device capable of delivering a 4-20 Ma analog rate of change signal.

Figure 20:
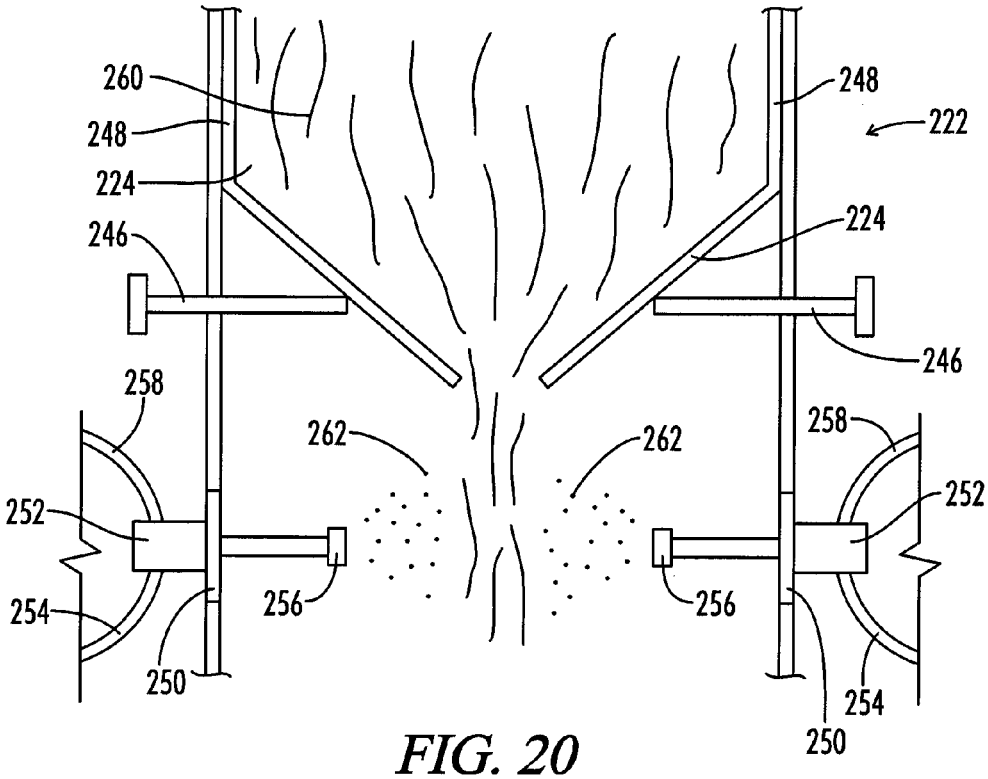
FIG. 20 is a schematic diagram of a cross sectional view along line 20-20 of FIG. 17. This figure illustrates an operational application chamber showing the materials in a truly dilute phase being guided into a flow path but the adjustable baffles such that the materials are treated by the atomized chemical entity which is expelled from the nozzles.

Referring now to FIG. 20, there is shown a schematic diagram of an embodiment of the application chamber 222 with material 260 flowing therethrough. Specifically, FIG. 20 is a schematic diagram of a cross sectional view along line 20-20 of FIG. 17. This figure shows the material 260, nozzle fittings 252, and nozzles 256 which are dispensing the chemical entity 262. As shown, the nozzles 256 are not directly within the flow path 244 of the material 260, thus avoiding excessive wear which results from physical contact.

Figure 21:
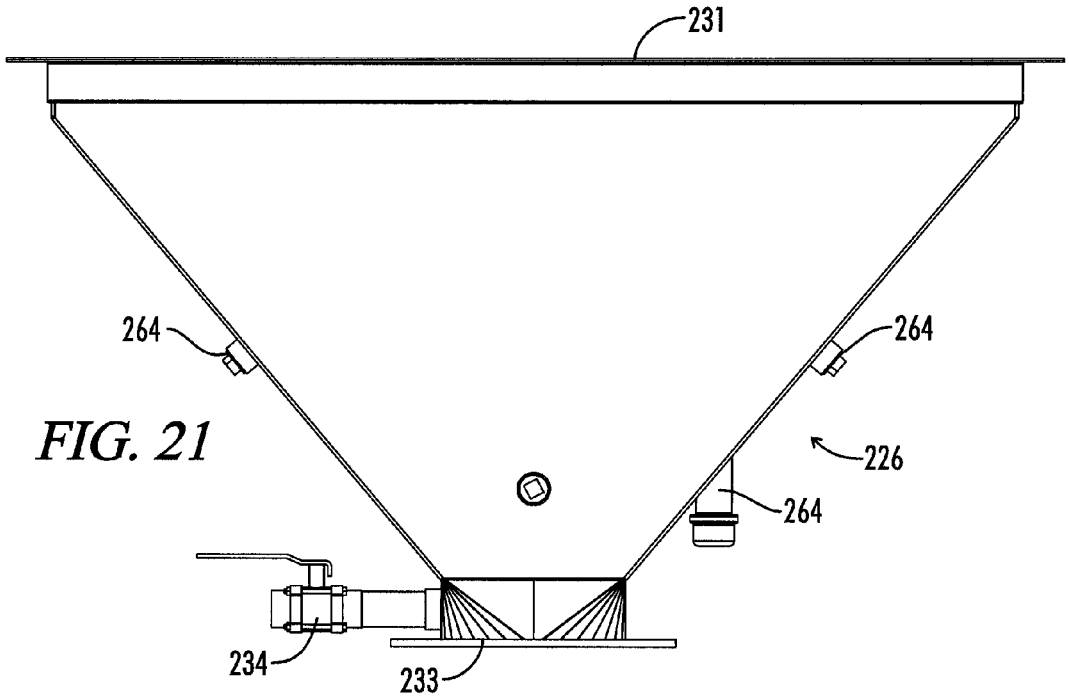
FIG. 21 is an end view of embodiment of the concentration chute. Shown there are the first opening and second opening, though which the materials enter and exit. Also shown are various sampling ports.
Figure 22:
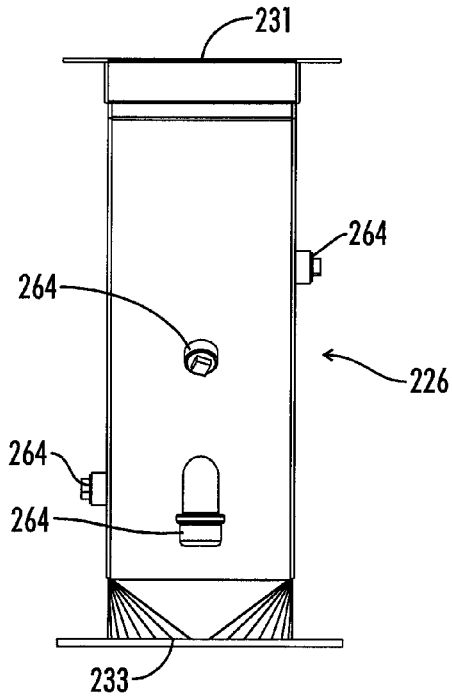
FIG. 22 is a side view of an embodiment of the concentration chute, which is shown in FIG. 21.

Referring now to FIG. 21, there is shown an embodiment of the concentration chute 226. The concentration chute 226 has a first opening 231 and a second opening 233. Also present on the concentration chute 226 are sample ports 264 and an air supply connector 234. The material 260 travels from the application chamber 222 to the concentration chute 226 in order to concentrate the material 260 into a dense phase from the truly dilute phase. Accordingly, the cross sectional area of the first opening 231 is significantly larger than the cross sectional area of the second opening 233. In certain embodiments, the cross sectional area of the first opening 231 is about five times greater than the cross sectional area of the second opening 233. In still other embodiments, the first opening 231 has a cross sectional area that is at least five times greater than the cross sectional area of the second opening 233. Shown in FIG. 22 is a side view of the concentration chute 226. Shown there are the first opening 231, the second opening 233, and the sample ports 264.

All references, publications and patents disclosed herein are expressly incorporated by reference. Also incorporated herein by reference, in their entirety, are Design and Control of Concrete Mixtures, $13^{th}$ Ed., by Steven H. Kosmatka and William C. Panarese, published by the Portland Cement Association, and Ready-Mixed, by D. Gene Daniel and Colin L. Lobo, published by National Ready Mixed Concrete Association and ASTM International.

Thus, it is seen that the material treatment system and method of use thereof of the present invention really achieves the ends and advantages mentioned as well as those inherent therein. While certain preferred embodiments of the invention have been illustrated and described for the purposes of the present disclosure, numerous changes in the arrangement in construction of parts may be made by those skilled in the art, which changes are encompassed within the scope and spirit of the present invention, as defined by the following claims.

What is claimed is:

1. A material treatment system, comprising:

a conduit for receiving material;

a fluidized bed chamber defining a first opening and a second opening, the first opening being in fluid communication with the conduit, the cross sectional area of the first opening being at least five times greater than the cross sectional area of the second opening;

a discharge chamber attached to the fluidized bed chamber in order to receive the fluidized material;

an application chamber attached to the discharge chamber, the application chamber having adjustable baffles so that the thickness of the flow path of the material is adjustable, the application chamber having a plurality of nozzles for applying a chemical entity to the material;

a concentration chute having a first opening and a second opening, the first opening being attached to the application chamber, the first opening having a cross sectional area that is at least five times greater than the cross sectional area of the second opening, so that the material is concentrated for passage through the second opening of the concentration chute;

a chemical conduit attached to the application chamber;

a chemical pump attached to the chemical conduit.

2. The treatment system of claim 1, further comprising a master flow controlling device communicationally attached to the chemical pump so that the chemical pump decreases or increases a rate of chemical flow in response to a signal from the master flow controlling device.

3. The treatment system of claim 1, further comprising the fluidized bed chamber having a deflection gate, wherein the deflection gate is the width of the fluidized bed chamber in order to spread the material evenly so that it falls into the discharge chamber in an even manner.

4. The treatment system of claim 3, wherein the deflection gate is adjustable.

5. The treatment system of claim 4, wherein the nozzles are positioned directly beneath the adjustable baffles.

6. The treatment system of claim 3, wherein the deflection gate is adjustable to the deflection angle in order to alter the deflection of the material.

7. The treatment system of claim 1, wherein the plurality of nozzles includes nozzles on either side of the flow path of the material, the plurality of nozzles including a total of from about 10 nozzles to about 14 nozzles.

8. The treatment system of claim 1, wherein the plurality of nozzles includes nozzles on either side of the flow path of the material, the plurality of nozzles including about one nozzle on each side of the flow path of the material for each foot of a width of the application chamber.

9. The treatment system of claim 1, wherein a first opening of the conduit has a cross sectional area of from about 28 inches squared to about 114 inches squared.

10. The treatment system of claim 9, wherein the second opening of the fluidized bed chamber has a cross sectional area from about 600 inches squared to about 840 inches squared.

11. The treatment system of claim 10, wherein the adjustable baffles of the application chamber extend the width of the application chamber so that the thickness of the flow path is consistent along the width of the application chamber so that the flow path of the fly ash when received by the concentration chute is free falling.

12. The treatment system of claim 11, wherein the fluidized bed chamber has a sample port.

13. The treatment system of claim 12, wherein the concentration chute has a sample port.

* * * * *

UNITED STATES PATENT AND TRADEMARK OFFICE

CERTIFICATE OF CORRECTION

PATENT NO. : 7,938,571 B1
APPLICATION NO. : 11/827512
DATED : May 10, 2011
INVENTOR(S) : James H. Irvine It is certified that error appears in the above-identified patent and that said Letters Patent is hereby corrected as shown below:

In column 2: line 66, delete “first” and insert --second--, therefor; line 67, delete “second” and insert --first--, therefor.
In column 3: line 50, delete “first” and insert --second--, therefor.
In column 5: line 52, delete “but” and insert --by--, therefor.
In column 17: line 6, in claim 1, before ‘cross’ delete “the” and insert --a--, therefor; line 7, in claim 1, delete “the” and insert --a--, therefor, and delete “first” and insert --second--, therefor; line 8, in claim 1, delete “second” and insert --first--, therefor; line 13, in claim 1, before ‘thickness’ delete “the” and insert --a--, therefor, and before ‘flow’ delete “the” and insert --a--, therefor; line 19, in claim 1, delete “the” and insert --a--, therefor; line 32, in claim 3, before ‘width’ delete “the” and insert --a--, therefor.
In column 18: line 6, in claim 6, before ‘deflection’ delete “the” and insert --a--, therefor, and after ‘alter’ delete “the” and insert --a--, therefor; line 21, in claim 10, delete “a” and insert --the--, therefor; line 25, in claim 11, before ‘width’ delete “the” and insert --a--, therefor; line 28, in claim 11, delete “fly ash” and insert --material--, therefor.

Signed and Sealed this
Fourteenth Day of August, 2012

David J. Kappos

David J. Kappos
*Director of the United States Patent and Trademark Office*